US009914312B2

(12) United States Patent
Miyashita

(10) Patent No.: US 9,914,312 B2
(45) Date of Patent: Mar. 13, 2018

(54) RECORDING APPARATUS WITH MOVEABLE MEDIUM PRESSING MEMBER

(71) Applicant: SEIKO EPSON CORPORATION, Tokyo (JP)

(72) Inventor: Eiichi Miyashita, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/364,335

(22) Filed: Nov. 30, 2016

(65) Prior Publication Data

US 2017/0165982 A1 Jun. 15, 2017

(30) Foreign Application Priority Data

Dec. 9, 2015 (JP) ..... 2015-240311

(51) Int. Cl.
*B41J 11/00* (2006.01)

(52) U.S. Cl.
CPC ..... *B41J 11/0045* (2013.01)

(58) Field of Classification Search
CPC . B41J 11/0005; B41J 11/0006; B41J 11/0045; B41J 13/10; B41J 11/02; B41J 11/06; B41J 15/046
See application file for complete search history.

(56) References Cited

U.S. PATENT DOCUMENTS 5,844,584 A * 12/1998 Murphy, III ..... B41J 11/20 347/20
6,419,334 B1 * 7/2002 Akuzawa ..... B41J 25/006 347/37
9,162,452 B2 * 10/2015 Kitaoka ..... B41J 2/135
2005/0194730 A1 * 9/2005 Nishida ..... B41J 13/10 271/10.01
2010/0271453 A1 10/2010 Toya
2013/0050380 A1 2/2013 Sakano

FOREIGN PATENT DOCUMENTS

JP 2010-253795 A 11/2010
JP 2012-218354 A 11/2012
JP 2013-049238 A 3/2013
JP 2016-068540 A 5/2016

* cited by examiner

*Primary Examiner* — Henok Legesse
(74) *Attorney, Agent, or Firm* — Workman Nydegger

(57) ABSTRACT

A printer includes a head that is positioned at a plurality of recording positions by moving in a direction which is orthogonal to a transport direction of a sheet and a pressing member that has a medium guide surface which is able to face the sheet, in which when the head is positioned, the medium guide surface is positioned below the head surface, and during maintenance of the head, the medium guide surface is positioned above the head surface.

9 Claims, 10 Drawing Sheets

RECORDING APPARATUS WITH MOVEABLE MEDIUM PRESSING MEMBER

BACKGROUND

1. Technical Field

The present invention relates to a recording apparatus that is provided with a medium pressing member that is able to suppress lifting up of a medium from a support portion.

2. Related Art

In the related art, a recording apparatus is known that is provided with a transport portion that transports a sheet that is an example of a medium, and performs recording (printing) of an image or the like by discharging ink (liquid) from a liquid discharge surface of a head onto a printing surface of the sheet that is transported by the transport portion. For example, a transport portion is known that is provided with an endless transport belt that revolves suspended on a roller. The transport belt is able to adsorb and transport a surface on the opposite side from a printing surface of the transported sheet to a belt surface.

Although the sheet is adsorbed to the belt surface, the sheet lifting up from the belt surface leads to a reduction in printing quality. In addition, in a case where the sheet is transported in an undried state, an end portion of the sheet tends to curl and lift up from the belt surface. Therefore, a recording apparatus in JP-A-2012-218354 is provided with a medium pressing member that presses a medium on a medium guide surface that protrudes to a pressing position that is closer to the belt surface than a liquid discharge surface of a head at the upstream side of the head in order to suppress lifting up of the sheet from the belt surface.

Meanwhile, in a state in which the medium guide surface protrudes further than the liquid discharge surface of the head, there is a risk that maintenance of the head, for example, cleaning or capping of the head is obstructed by the medium pressing member. Therefore, the recording apparatus in JP-A-2012-218354 moves the medium pressing member such that the medium guide surface does not protrude further than the liquid discharge surface of the head during maintenance of the head.

Note that, in a case where a gap between the medium guide surface and the belt surface is large at the pressing position, there is a risk that a state in which the end portion of the sheet lifts from the belt surface tends to be permissible and printing quality reduces without performing appropriate printing. However, in a case where the gap between the medium guide surface and the belt surface at the pressing position is small with respect to curl of the sheet, there is a risk that clogging of sheets is generated without the sheets entering between the medium guide surface and the belt surface.

SUMMARY

An advantage of some aspects of the invention is to provide a recording apparatus which is able to appropriately suppress lifting up of a medium by a medium pressing member.

Hereinafter, means of the invention and operation effects thereof will be described.

A recording apparatus according to an aspect of the invention includes a head that moves in a movement direction that is orthogonal to a support surface of a support portion that supports a medium which is transported in a transport direction, is positioned at a plurality of recording positions in the movement direction, and discharges liquid from a liquid discharge surface onto the medium, and a medium pressing member that has a medium guide surface which is able to face the medium, in which when the head is positioned at the recording position, the medium pressing member is held at a pressing position corresponding to the plurality of recording positions with at least a part of the medium guide surface closer to the support surface than the liquid discharge surface of the head, whereas during maintenance of the head, the medium pressing member is able to move from the pressing position to a retreat position at which the medium guide surface is further away from the support surface than the liquid discharge surface of the head.

According to the configuration above, a position of the medium guide surface in the medium pressing member for suppressing lifting up of the medium is able to be moved in different manners when the head is positioned at the recording position and during maintenance of the head. Therefore, it is possible to appropriately suppress lifting up of the medium since it is possible to change a gap between the medium guide surface and the support surface corresponding to a thickness, a state, and the like of the medium.

In addition, in the recording apparatus, it is preferable that a direction in which the medium pressing member moves from the pressing position to the retreat position is along the movement direction of the head.

For example, in a case where the movement direction from the pressing position of the medium pressing member to the retreat position and the movement direction of the head are orthogonal, there is a risk that the printing apparatus increases in size due to a plurality of spaces being provided in order to move the medium pressing member and the head in the recording apparatus. In this point, according to the configuration described above, since a direction along which the medium pressing member moves to the retreat position is along the movement direction of the head, it is possible to reduce the size of the printing apparatus in comparison to a case where the direction along which the medium pressing member moves to the retreat position is not along the movement direction of the head.

In addition, in the recording apparatus, it is preferable that the medium pressing member moves in the movement direction in conjunction with the movement of the head.

According to the configuration described above, it is possible to make a driving source for moving the head and a driving source for moving the medium pressing member common.

In addition, in the recording apparatus, it is preferable to provide a head frame that supports the head and moves the head in the movement direction and a regulating member that engages with an engaging portion provided in the medium pressing member and regulates movement of the medium pressing member during maintenance of the head, in which the head moves to a side approaching the support portion in the movement direction during maintenance of the head, and the medium pressing member is supported on the head frame that is able to be held at the pressing position further on the upstream side in the transport direction than the head, and during maintenance of the head, moves in a direction further away from the support surface than the liquid discharge surface of the head due to regulation of movement to the side that approaches the support portion in the movement direction using the regulating member.

According to the configuration described above, the pressing position is changed by also moving the medium pressing member that is supported on the head frame when the recording position of the head is changed by moving the head in the movement direction. Therefore, since it is possible that an amount of movement of the head and an amount of movement of the pressing member are the same, when the recording position is changed according to a thickness, a state, or the like of the medium, it is also possible to change the pressing position to a position corresponding to the thickness, the state, or the like of the medium.

In addition, in the recording apparatus, it is preferable that the medium pressing member is biased toward the side that approaches the support portion in the movement direction with respect to the head frame.

According to the configuration described above, since the medium pressing member is biased toward the side that approaches the support portion in the movement direction, it is possible to further suppress lifting up of the medium and it is possible to reduce a load that is applied in transport of the medium.

In addition, in the recording apparatus, it is preferable to provide the head frame that supports the head and moves the head in the movement direction, a biasing member that applies force toward the head frame in the medium pressing member, and the regulating member that regulates movement of the medium pressing member by contacting the medium pressing member at the pressing position, in which the medium pressing member is supported on the head frame that is able to be held at the pressing position further on the upstream side in the transport direction than the head, and during maintenance of the head, moves in a direction further away from the support surface than the liquid discharge surface of the head by moving the regulating member inside the head frame.

According to the configuration described above, the pressing position is changed by also moving the medium pressing member that is supported on the head frame when the recording position of the head is changed by moving the head in the movement direction. Therefore, since it is possible that the amount of movement of the head and the amount of movement of the pressing member are the same, when the recording position is changed according to a thickness, a state, or the like of the medium, it is also possible to change the pressing position to a position corresponding to the thickness, the state, or the like of the medium.

In addition, in the recording apparatus, it is preferable to provide the head frame that supports the head and a cam that moves the head in the movement direction by moving the head frame in the movement direction, in which the medium pressing member is moved in the movement direction by the cam.

According to the configuration described above, since it is possible to move the pressing member using the cam that moves the head in the movement direction, it is possible to simultaneously perform movement of the head and the medium pressing member using the cam.

In addition, in the recording apparatus, it is preferable that the medium guide surface includes the outer peripheral surface of a roller.

According to the configuration described above, since the outer peripheral surface of the roller is included on the medium guide surface, movement in the transport direction when the medium contacts the medium guide surface is assisted by the roller. Therefore, it is possible to reduce the load that is applied in transport of the medium.

In addition, in the recording apparatus, the support portion is a transport belt that transports the medium using electrostatic adsorption.

According to the configuration described above, lifting up of the medium is further suppressed due to electrostatic adsorption of the transport belt.

BRIEF DESCRIPTION OF THE DRAWINGS

The invention will be described with reference to the accompanying drawings, wherein like numbers reference like elements.

DESCRIPTION OF EXEMPLARY EMBODIMENTS

As a first embodiment of a recording apparatus, an ink jet type printer which is provided with a head that discharges ink that is an example of liquid, and performs printing (recording) of an image which includes characters, graphics, and the like by discharging ink onto sheet which is an example of a medium is described below with reference to the drawings.

Figure 1:
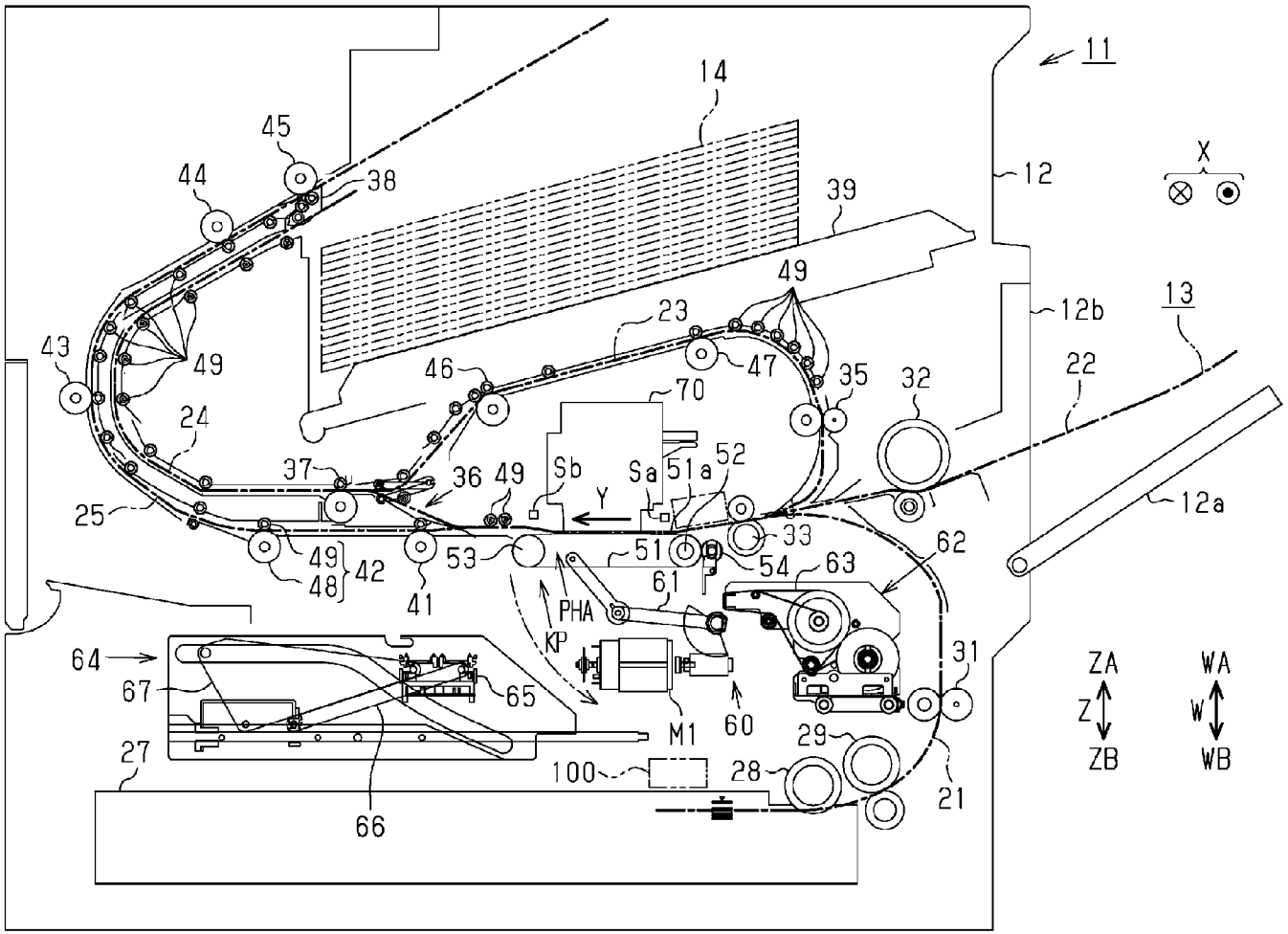
FIG. 1 is a front surface view illustrating a schematic structure of an embodiment of a recording apparatus.

As shown in FIG. 1, a printer 11 as an example of the recording apparatus of the embodiment has a casing 12 which is an approximately rectangular parallelepiped made from a plurality of outer cases and the like as an apparatus main body. As indicated by a thick dashed line in FIG. 1, the printer 11 is provided with a transport path 13, which transports a sheet 14, in the casing 12. Then, a transport portion 50 which transports the sheet 14 and a recording portion 70 which performs recording by discharging ink onto the transported sheet 14 are mounted in the casing 12 along the transport path 13. The transport portion 50 is provided with a plurality of pairs of rollers which transport the sheet 14 and a transport belt 51 which transports the sheet 14 while supporting from a downward ZB side in a vertical direction Z. The transport belt 51 is mounted in the casing 12 in a state of being movable to a first position facing the recording portion 70 by interposing the transport path 13, that is, a usable state using a belt moving portion 60.

The recording portion 70 is a so-called line head in which a width direction X that intersects with (here is orthogonal to) a transport direction Y of the sheet 14 is set as a longitudinal direction, and has a head 72 which is able to simultaneously discharge ink across the longitudinal direction. The recording portion 70 which is a line head performs printing as recording by discharging ink from an upward ZA side (upper side) toward the sheet 14 which is transported in the state of being supported on the transport belt 51. Note that, the position of the transport belt 51 when printing is performed on the sheet 14 using the recording portion 70, that is, the first position at which the transport belt 51 faces the recording portion 70 is referred to as a transport position KP.

The transport path 13 is configured by a first supply path 21 and a second supply path 22 further on the upstream side in a transport direction Y than the recording portion 70, a third supply path 23, a branching path 24, and a discharge path 25 further on the downstream side in the transport direction Y than the recording portion 70.

The first supply path 21 is a path which links the recording portion 70 and a paper cassette 27 which is removably provided in a bottom portion that is on the downward ZB side of the casing 12. Then, out of the sheet 14 which is mounted in a laminated state in the paper cassette 27, a pick-up roller 28 which delivers the sheet 14 of a highest layer, and a separation roller 29 which separates the sheets 14 one sheet at a time which is delivered by the pick-up roller 28 are provided on the first supply path 21. Furthermore, a first supply roller pair 31 is provided more on the transport direction Y downstream side than the separation roller 29.

The second supply path 22 is a path which links the recording portion 70 and an insertion portion 12*b* which is exposed by opening a cover 12*a* that is provided on one side surface of the casing 12. Then, a second supply roller pair 32 which supports and transports the sheet 14 that is inserted from the insertion portion 12*b* is provided on the second supply path 22. Furthermore, a third supply roller pair 33 is provided at a position at which the first supply path 21, the second supply path 22, and the third supply path 23 converge, and a fifth supply roller pair 35 is provided on the third supply path 23.

The third supply path 23 is a path which is provided so as to surround the recording portion 70, and is a path for returning the sheet 14 which passes once through the recording portion 70 again further to the upstream side than the recording portion 70. That is, a branching mechanism 36 is provided further on the downstream side than the recording portion 70, and a branching roller pair 37, which is able to rotate both forward and reversely, is provided on the branching path 24 which branches from the discharge path 25.

The discharge path 25 is a path which links the recording portion 70 and a discharge port 38 through which the printed sheet 14 is discharged. Note that, the sheet 14 which is discharged from the discharge port 38 is mounted onto a mounting base 39. Then, at least one transport roller pair (a first transport roller pair 41 to a fifth transport roller pair 45 in the embodiment) is provided on the discharge path 25. Furthermore, a sixth transport roller pair 46 and a seventh transport roller pair 47 are also provided on the third supply path 23. The first transport roller pair 41 to the seventh transport roller pair 47 support and transport the sheet 14 on which ink is adhered.

That is, the first transport roller pair 41 to the seventh transport roller pair 47 are respectively configured by a cylindrical driving roller 48 which rotates based on driving force of a driving source, and a toothed roller 49 which is driven to rotate accompanying the rotation of the driving roller 48. In addition, the toothed roller 49 is also provided alone without being paired with the driving roller 48. That is, the toothed roller 49 is provided on a side through which a printing surface (recording surface) of the sheet 14 on which printing is executed passes on the third supply path 23, the branching path 24, and the discharge path 25. In addition, the toothed roller 49 is also provided between each transport roller pair of the first transport roller pair 41 to the seventh transport roller pair 47 in the transport direction, and also provided between each transport roller pair and the recording portion 70. Meanwhile, the driving roller 48 is provided on a side through which a non-printing surface (non-recording surface) of the sheet 14 on which printing is not executed, or a surface of the sheet 14, which is printed on both surfaces, that has already been printed passes.

In the embodiment, the transport belt 51 at the transport position KP that faces the recording portion 70 transports the sheet 14 by revolving in a state in which the sheet 14 is supported by being electrostatically adsorbed to a belt surface 51*a* which is an outer peripheral surface of the transport belt 51. That is, the transport belt 51 transports the sheet 14 by electrostatic adsorption. In this point, the transport belt 51 is equivalent to "a support portion that supports the sheet 14 which is transported in the transport direction Y", and the belt surface 51*a* is equivalent to "a support surface".

That is, the transport belt 51 is an endless belt which is stretched between two rollers, one roller out of the two rollers is set as a driving roller 52 which is rotated by the driving source, and the other roller is set as a driven roller 53 which is rotated accompanying the revolving of the belt. In addition, a charging roller 54 is configured by a rubber layer on a front surface of a metal roller shaft, and applies high pressure to an end portion of the roller shaft by directly coming into contact with a leaf spring which is not shown in the drawings. Alternatively, the charging roller 54 may be configured such that a bearing portion which receives the roller shaft of the charging roller 54 is a conductive bearing (a conductive resin, a sintered bearing, or the like), and to apply high pressure via the conductive bearing. Then, the transport belt 51 rotates accompanying revolving of the driving roller 52, and during the revolving, static electricity is charged to the transport belt 51 by the charging roller 54 which comes into contact with the belt surface 51*a*. Note that, it is preferable that the charging roller 54 alternately supplies positive electrical charge and negative electrical charge to the transport belt 51. Due to the charged static electricity, the transport belt adsorbs the sheet 14 on the flat belt surface 51*a*, on the upward ZA side, that is formed between the driving roller 52 and the driven roller 53, and transports the adsorbed sheet 14 in the transport direction Y while facing the recording portion 70.

In addition, in the embodiment, with respect to the recording portion 70, a first sensor Sa which detects the sheet 14 on the transport direction Y upstream side, and a second sensor Sb which detects the sheet 14 on the transport direction Y downstream side are disposed. The first sensor Sa and the second sensor Sb are sensors (for example, optical sensors) in an "ON" state in which a predetermined signal is output when the sheet 14 is detected, and in a case where the sheet 14 is transported by the transport belt 51 without delay, the second sensor Sb is turned "ON" a predetermined time after the first sensor Sa is turned "ON".

In the printer 11, the transport belt 51 is provided with the belt moving portion 60 which is moved from the transport position KP where printing is performed by the recording portion 70 to the second position which is further away from the recording portion 70 than the transport position KP. That is, the belt moving portion 60 has a linking member 61 which operates accompanying driving of the first motor M1 as the driving source. The linking member 61 operates in accordance with the driving of the first motor M1, and as indicated by the chain double-dashed line arrow in FIG. 1, the transport belt 51 is moved from the transport position KP which is the first position to the second position which is further away from the recording portion 70 than the transport position KP by swinging the driven roller 53 side downward ZB centered on the driving roller 52.

Figure 2:
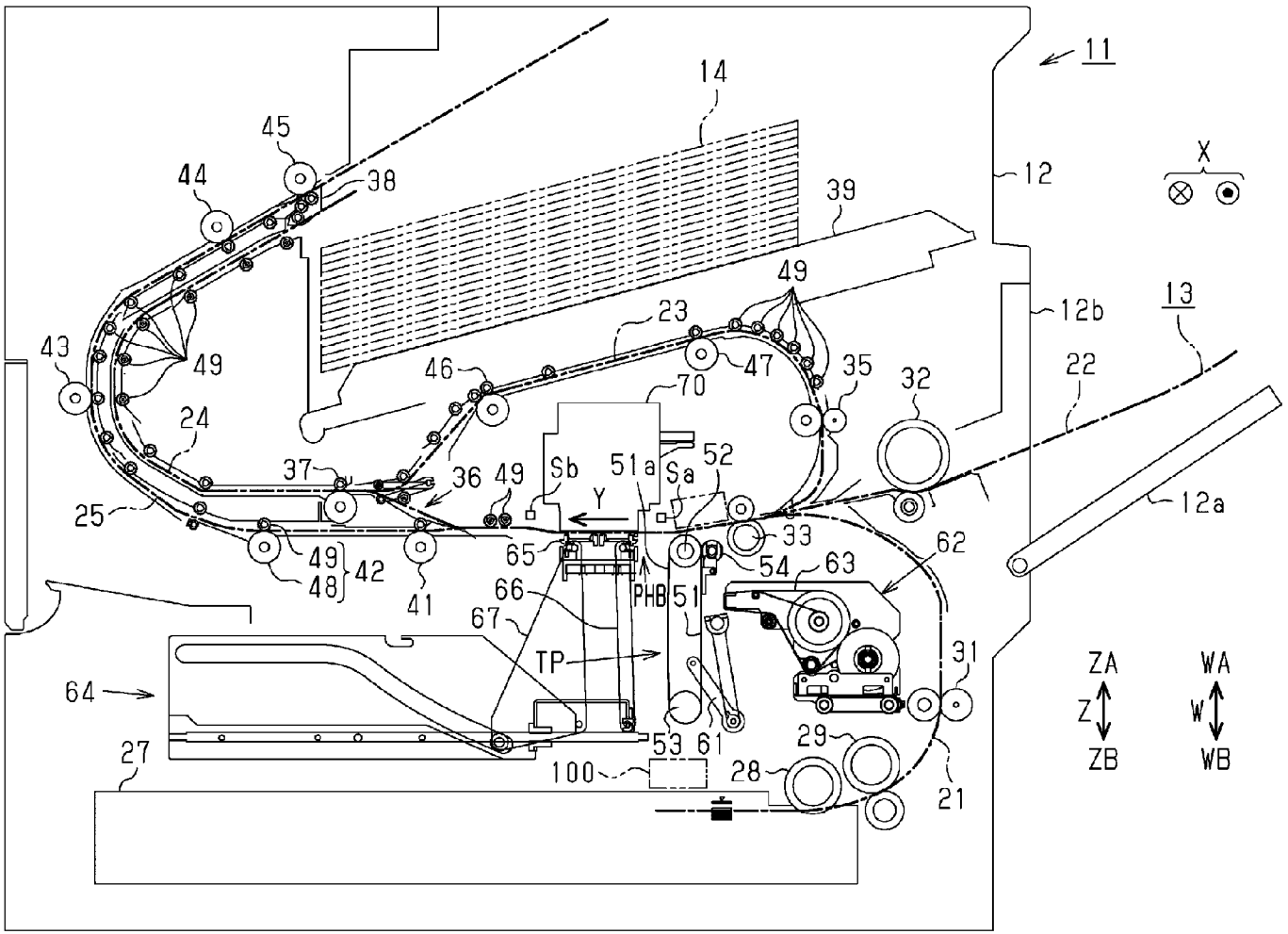
FIG. 2 is a front surface view illustrating a state in which a transport belt is separated from a recording portion in FIG. 1 and a cap is contacted.

As shown in FIG. 2, in the embodiment, a position at which the transport belt 51 is rotated (swung) approximately 90 degrees from the transport position KP centered on the driving roller 52 is set as the second position, and the second position is referred to as a cleaning position TP. Then, in the embodiment, the belt surface 51*a* of the transport belt 51 has a horizontal attitude which is a substantially horizontal plane at the transport position KP, and has a vertical attitude which is a substantially vertical plane along the vertical direction Z at the cleaning position TP.

Note that, the state in which the transport belt 51 is in the cleaning position TP is a state in which printing is not performed on the sheet 14 by the recording portion 70. Therefore, in the printer 11, for example, printing performance (for example, printing quality) of the recording portion 70 is to be maintained by suppressing drying of ink within the recording portion 70, and as shown in FIG. 2, a cap movement mechanism 64 which covers the recording portion 70 is provided to come into contact with a cap 65 from the downward ZB side with respect to the recording portion 70 which is in a state of not performing printing.

The cap movement mechanism 64 has a structure in which a first member 66 and a second member 67, which hold the cap 65 that is able to cover at least a portion which discharges ink in the recording portion 70 with the closed space, move (move up and down) the cap 65 along the vertical direction Z using a linking mechanism and a cam mechanism when reciprocally moving along the transport direction Y. Then, as shown in FIG. 1, in a state of being separated from the recording portion 70 and not covering the recording portion 70, the members which configure the cap 65 and the cap movement mechanism 64 (for example, the first member 66 and the second member 67) are disposed at a position which does not come into contact with the transport belt 51 that is moved (swung) between the transport position KP and the cleaning position TP as indicated by a chain double-dashed line arrow in FIG. 1. In other words, the transport belt 51 is provided in the printer 11 so as not to come into contact with the cap 65 and the cap movement mechanism 64 in the state of not covering the recording portion 70 in the movement between the transport position KP and the cleaning position TP.

In addition, as shown in FIGS. 1 and 2, a cleaning unit 62 which has a cleaning member 63 that removes dirt of the transport belt 51 attached near the transport belt 51 at the second position is provided in the printer 11.

The cleaning unit 62 is set to be able to reciprocally move along the transport direction Y in accordance with the movement of the motor as the driving source which is not shown in the drawings, and cleans dirt such as ink away which adheres to the belt surface 51*a* by wiping by the cleaning member 63 coming into contact with the belt surface 51*a* of the transport belt 51 due to the movement in the transport direction Y.

In the cleaning unit 62, the cleaning member 63 such as a woven fabric (web) is supported on a frame (illustration omitted) on both end portions in the width direction X which intersects with the transport direction Y in a state of being wound in a roll form on a roll core with a round shaft form.

The cleaning unit 62 is configured to reciprocally move (slidably move) along the transport direction Y using a driving source which is not shown in the drawings (for example, an actuator). Along with the movement of the cleaning unit 62, the cleaning member 63 contacts the belt surface 51*a* of the transport belt 51 at the second position in FIG. 2. A control device 100 performs cleaning of the belt surface 51*a* using the cleaning member 63 by rotating the charging roller 54 in a state in which the cleaning member 63 and the belt surface 51*a* are in contact.

Cleaning by the cleaning unit 62 is executed in a case where it is estimated, for example, that the transport belt 51 is dirty. The operation processes are executed by the control device 100.

The control device 100 is configured by a central processing unit (CPU), a storage device (memory), various driving circuits, and the like, and controls the printing process of a process in the recording portion 70 in which ink is discharged and the like. The control device 100 executes each process by drivably controlling each driving source and the like in a predetermined order.

If the first sensor Sa is turned "ON", during printing on the sheet 14, the control device 100 executes, for example, a process in which printing is started based on printing data that is input to the printer 11, that is, a process in which ink discharge starts in the recording portion 70. Then, the control device 100 performs a determination process of whether or not the second sensor Sb is turned "ON" within a set time, that is, whether or not an elapsed time from the first sensor Sa detecting the sheet 14 to the second sensor Sb detecting the sheet 14 is within the set time. For example, the set time is a time reaching from the first sensor Sa to the second sensor Sb of a case of the sheet 14 being transported along the transport path 13 without delay.

In a case where the second sensor Sb is turned "ON" and detects the sheet 14 within the set time, since the sheet 14 is transported on the transport path 13 without delay, after a current printing resumption process is performed, comes to be in the printing standby state which is to be performed in subsequent printing. Meanwhile, in a case where the second sensor Sb is not turned "ON" within the set time, that is, in a case where the second sensor Sb does not detect the sheet 14, the sheet 14 is estimated to be in a jam state in which transport of the sheet 14 by the transport belt 51 on the transport path 13 is delayed. In a case where the sheet 14 is in a jam state (paper jam) in this manner, it is possible that adherence of ink which is discharged in the recording portion 70 to the transport belt 51 without being adhered to the sheet 14 occurs. In addition, when the paper jam process is performed in which the sheet 14 in which transport by a user is delayed is removed, it is possible that adherence of ink around the recording portion 70 occurs due to the sheet 14 to which ink adheres being dragged. Therefore, after the paper jam process is performed by the user, the control device 100 moves the transport belt 51 to the second position since cleaning of the transport belt 51 is performed by the cleaning unit 62. Meanwhile, the control device 100 moves a cap movement mechanism 64 from a position not covering the recording portion 70 illustrated in FIG. 1 to a position covering the recording portion 70 illustrated in FIG. 2.

The recording portion 70 will be described with reference to FIGS. 3 and 4.

The recording portion 70 is provided with a head frame 71 that is supported in the casing 12 (refer to FIG. 1), a head 72 that discharges ink (liquid) from the liquid discharge surface (hereinafter "head surface 72*a*") onto the sheet 14, and a movement mechanism 75 (refer to FIG. 5) that moves the head 72.

The head frame 71 is provided with an ink accommodating portion 73 that accommodates ink on the upward ZA side in the vertical direction Z. A nozzle (illustration omitted) which discharges ink within the ink accommodating portion 73 toward the sheet 14 that is transported by the transport belt 51 is formed on the head surface 72*a* of the head 72.

Figure 4:
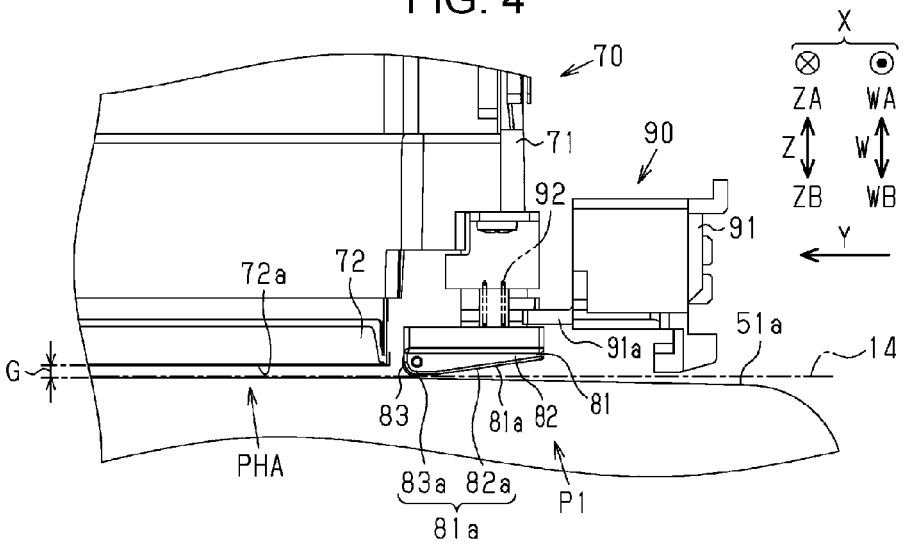
FIG. 4 is a partial enlarged view of FIG. 3.

As shown in FIG. 4, in the head 72, the head surface 72*a* is supported on the head frame 71 to be parallel to the belt surface 51*a* at the transport position KP. During printing on the sheet 14, the head surface 72*a* is held at a position (hereinafter, "recording position") separated by a predetermined distance from the belt surface 51*a*. Hereinafter, "gap G" refers to a distance between the head surface 72*a* and the belt surface 51*a* during printing on the sheet 14.

Figure 5:
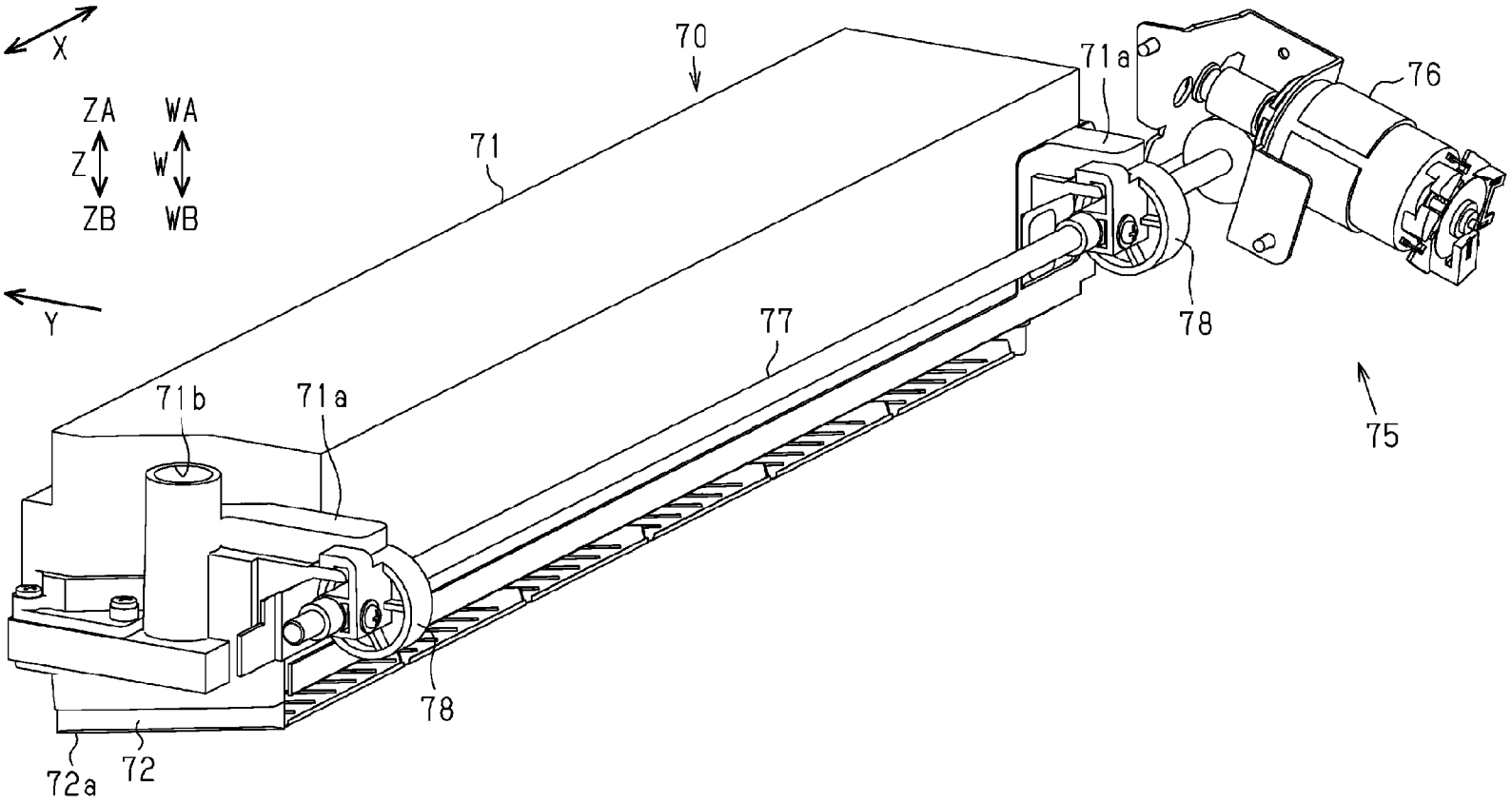
FIG. 5 is a perspective view of a movement mechanism.

The head 72 moves in a movement direction W that is orthogonal to the belt surface 51*a* of the transport belt 51 using the movement mechanism 75 (refer to FIG. 5). The head 72 is held at a recording position PHA that has different gaps G by moving in the movement direction W using the movement mechanism 75. That is, the head 72 is positioned at a plurality of recording positions PHA in the movement direction W.

As shown in FIG. 5, the movement mechanism 75 is provided with a motor 76 that is a driving source, a cam shaft 77 that transmits rotation of the motor 76, and a cam 78 that is provided in the cam shaft 77. The motor 76 is supported in the casing 12 (refer to FIG. 1), and is connected to one end portion of the cam shaft 77 that extends in the width direction X. The cam 78 is provided in the vicinity of both end portions of the cam shaft 77 in an axial direction. The outer periphery of the cam 78 has a circular shape, and the cam shaft 77 is inserted at a position that is eccentric from the center of the cam 78. In the head frame 71, a cam receiving portion 71*a* is provided at a position that is able to contact a part on the upward ZA side of the cam 78, and a guide portion 71*b* for moving the head frame 71 along the movement direction W is provided. The guide portion 71*b* is a cylindrical member that extends in the vertical direction Z, and a rod shape member (illustration omitted) that is supported inside the casing 12 (refer to FIG. 1) is accommodated to be able to slide. Therefore, the head frame 71 and the head 72 that is supported on the head frame 71 is able to move along the movement direction W that extends along the guide portion 71*b*. In other words, the head frame 71 moves the head 72 in the movement direction W. In the embodiment, the movement direction W of the head frame 71 coincides with the vertical direction Z since the guide portion 71*b* extends in the vertical direction Z. In addition, the movement direction W is orthogonal to the belt surface 51*a* of the transport belt 51.

When the motor 76 is rotated, the cam 78 rotates eccentrically. Thereby, the head 72 is pressed up to a separation direction WA side that is separated from the belt surface 51*a* in the movement direction W via the cam receiving portion 71*a*, or is lowered to an approach direction WB side that approaches the belt surface 51*a* in the movement direction W in accordance with gravity. When the head 72 indicated in FIG. 4 is moved in the separation direction WA, since the head surface 72*a* moves in a direction separated from the belt surface 51*a*, the gap G is increased. When the head 72 is moved in the approach direction WB, since the head surface 72*a* moves in a direction approaching the belt surface 51*a*, the gap G is reduced. That is, the head 72 is able to take a plurality of recording positions PHA due to rotation of the motor 76. In addition, the head 72 is held at the plurality of recording positions PHA in the movement direction W by stopping rotation of the motor 76.

Figure 3:
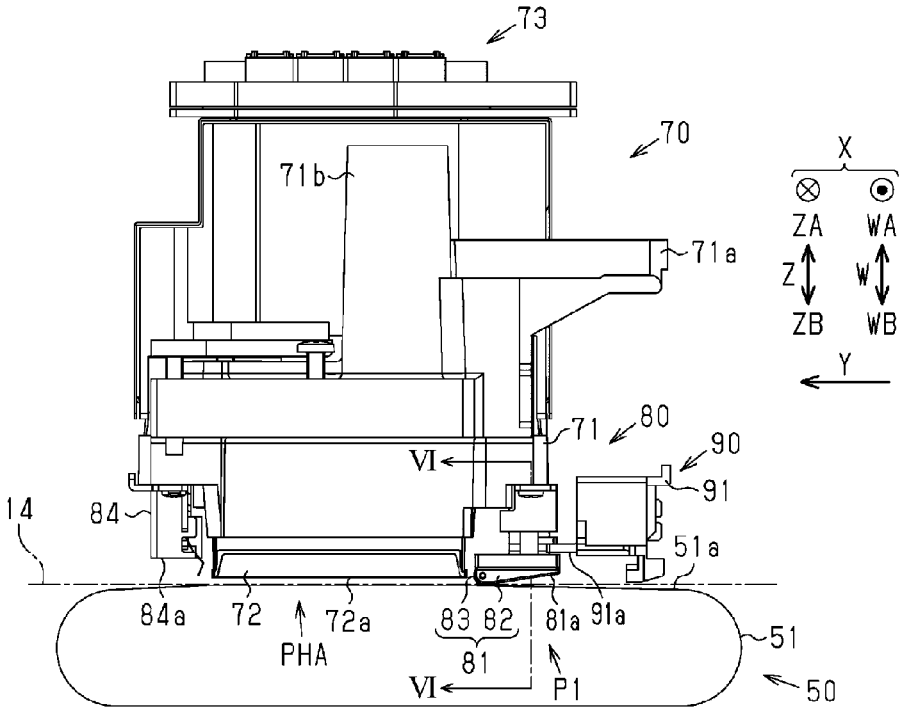
FIG. 3 is a side surface view of the recording portion when the recording portion is at a recording position.

As shown in FIG. 3, a pressing mechanism 80 that suppresses lifting up of the sheet 14 is provided on the upstream side and the downstream side of the recording portion 70 in the transport direction Y. A first pressing member 81 is provided on the end portion on the upstream side of the recording portion 70 in the transport direction Y and a second pressing member 84 is provided on the end portion on the downstream side.

As shown in FIG. 4, the first pressing member 81 is supported on the head frame 71 to be able to be held at a pressing position P1 further at the upstream side in the transport direction Y than the head 72. The first pressing member 81 has a medium guide surface 81*a* that is able to face the sheet 14. In this point, the first pressing member 81 is equivalent to the "medium pressing member". The first pressing member 81 is configured by a plurality of guide members 82 and a plurality of rollers 83. The plurality of guide members 82 and a plurality of rollers 83 are respectively disposed lined up in the width direction X. The guide member 82 is provided with an inclined surface 82*a* that is able to face the belt surface 51*a*. The inclined surface 82*a* is inclined from upward ZA toward downward ZB in the vertical direction Z from the upstream side toward the downstream side in the transport direction Y. The roller 83 is supported to be able to able to rotate in the guide member 82 at an end portion of the guide member 82 on the downstream side in the transport direction Y. For the roller 83, the axial direction coincides with a direction (width direction X) that is orthogonal to the transport direction Y. The medium guide surface 81*a* is configured by the inclined surface 82*a* and an outer peripheral surface 83*a* of the roller 83. That is, the medium guide surface 81*a* includes the outer peripheral surface 83*a* of the roller 83. The first pressing member 81 is positioned by the head frame 71 and a holding mechanism 90 that is provided in the first pressing member 81.

As shown in FIG. 3, the second pressing member 84 is supported on the head frame 71 further at the downstream side in the transport direction Y than the head 72. The second pressing member 84 is supported on the head frame 71. A lower surface 84*a* that is able to face the sheet 14 of the second pressing member 84 is positioned further at the separation direction WA side in the movement direction W than the head surface 72*a* of the head 72. The second pressing member 84 suppresses lifting up of the sheet 14, which is printed by the recording portion 70, from the belt surface 51*a* rather than the lower surface 84*a*.

The configuration of the holding mechanism 90 will be described with reference to FIGS. 4 and 6 to 8.

As shown in FIG. 4, the holding mechanism 90 is provided with a regulating member 91 that regulates movement of the first pressing member 81 and a biasing member 92 that biases the first pressing member 81 toward a side (approach direction WB side) that approaches the belt surface 51*a* in the movement direction W with respect to the head frame 71.

Figure 6:
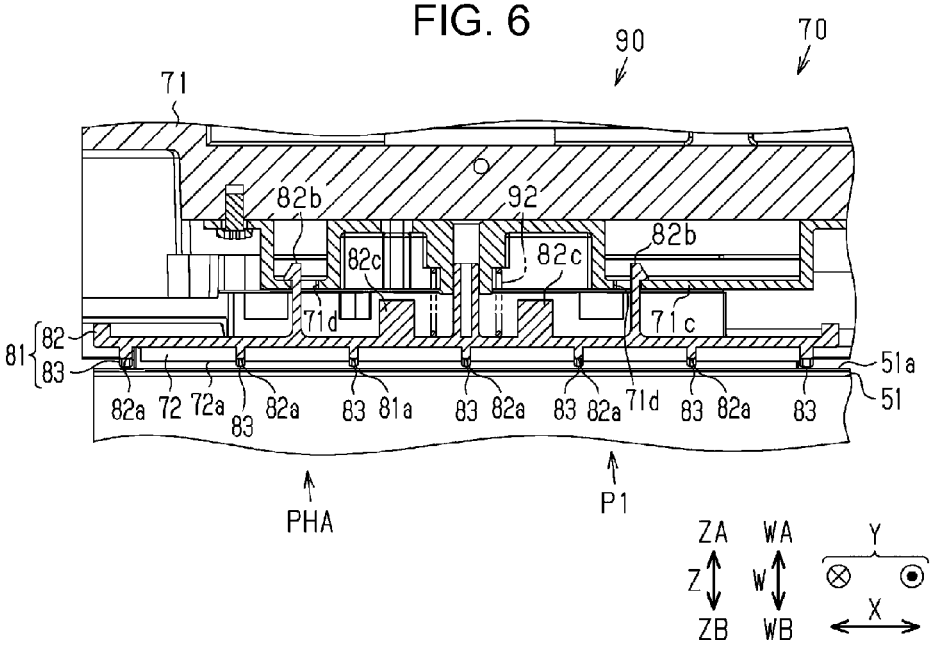
FIG. 6 is a sectional view taken along line VI-VI in FIG. 3.

As shown in FIG. 6, the guide member 82 is provided with a plurality of claws 82*b* that protrude to the upward ZA side in the vertical direction Z. A tip end of the claw 82*b* on the upward ZA side is inserted into a hole 71*d* such that it is possible to catch the edge of the hole 71*d* of a holding portion 71*c* that is provided in a part of the head frame 71 on the downward ZB side in the vertical direction Z. A biasing member 92 that applies force toward the downward ZB in the vertical direction Z in the guide member 82 is disposed between the head frame 71 and the guide member 82. Therefore, when the head frame 71 is moved in the approach direction WB in the movement direction W, the guide member 82 moves in the approach direction WB along with the head frame 71 due to the biasing member 92 and gravity. In addition, when the head frame 71 is moved in the separation direction WA in the movement direction W, the claw 82*b* catches the edge of the hole 71*d* and the guide member 82 moves in the separation direction WA along with the head frame 71 due to the biasing member 92 and gravity. In this manner, the first pressing member 81 moves in the movement direction W in conjunction with the head 72. As long as the claw 82*b* is caught on the edge of the hole 71*d*, at least a part of the medium guide surface 81*a* of the first pressing member 81 is positioned further on the approach direction WB side than the head surface 72*a*. Note that, hereinafter, when at least a part of the medium guide surface 81*a* of the first pressing member 81 is positioned further on the approach direction WB side than the head surface 72*a*, the position of the first pressing member 81 is the pressing position P1. The pressing position P1 is able to move along the movement direction W.

Figure 7:
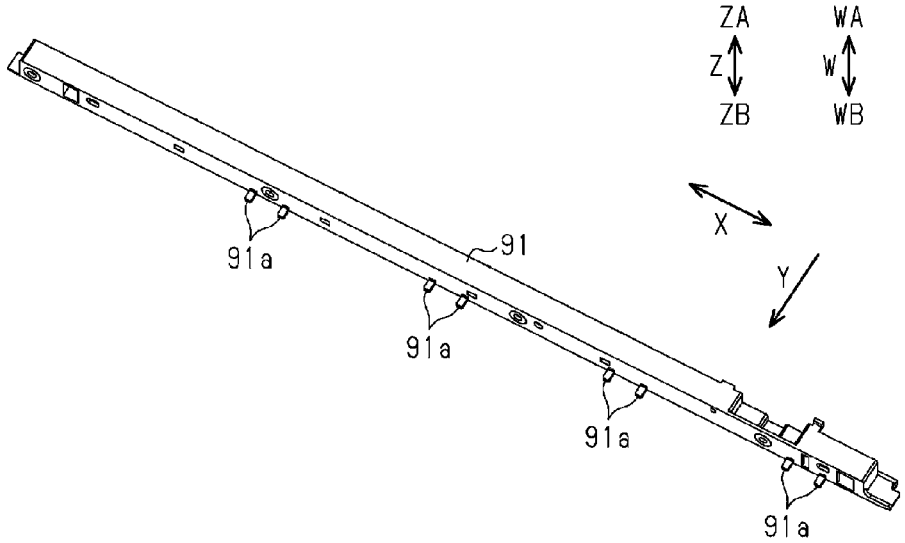
FIG. 7 is a perspective view of a regulating member.

As shown in FIG. 7, the regulating member 91 is a long member that extends in the width direction X, and both end portions in the axial direction are immovably supported in the casing 12 with respect to the casing 12 (refer to FIG. 1). The regulating member 91 is provided with a plurality of protruding portions 91*a* that protrude toward the downstream side in the transport direction Y. The plurality of protruding portions 91*a* are provided lined up in the width direction X.

Figure 8:
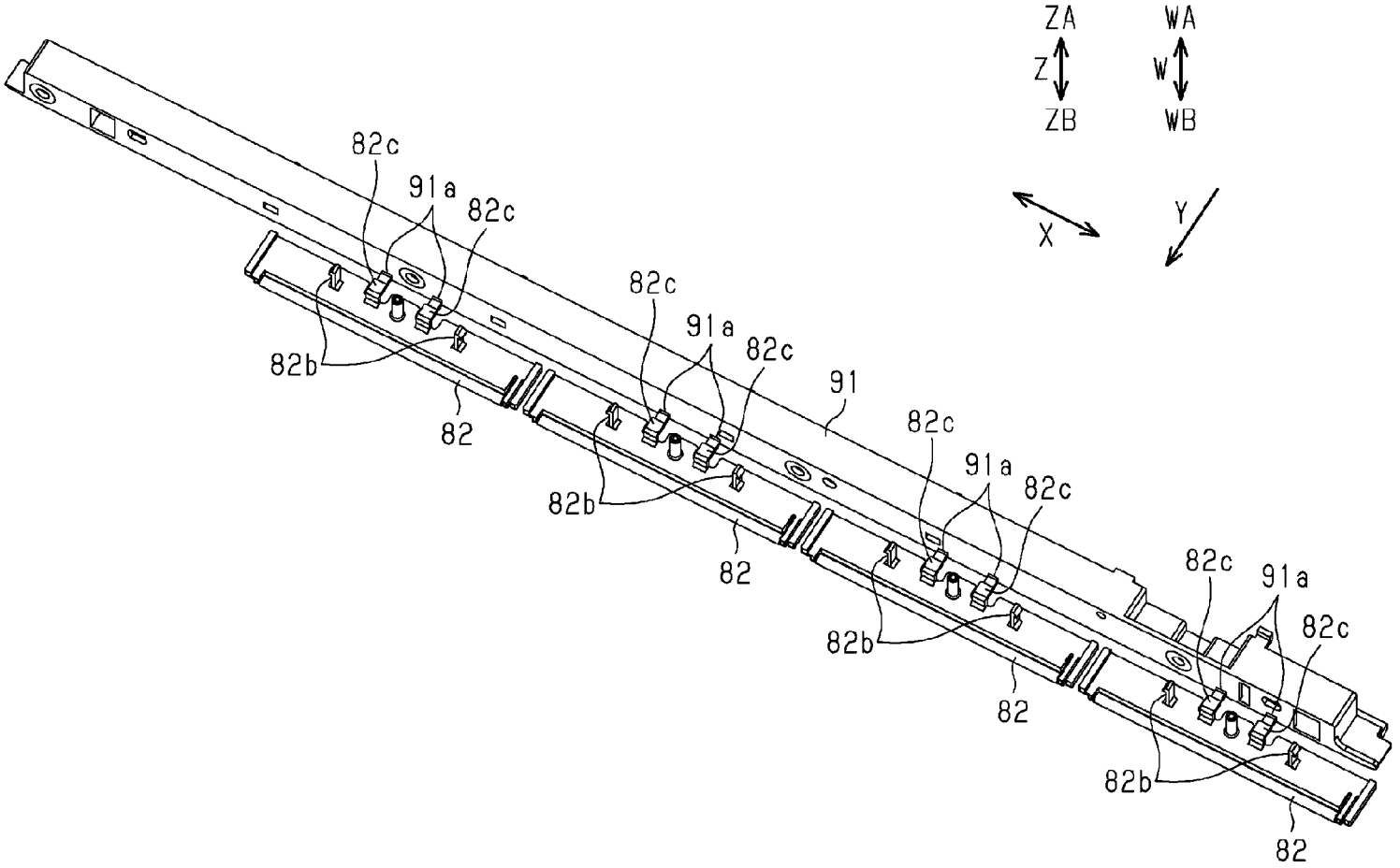
FIG. 8 is a perspective view illustrating a state in which the regulating member and a guide member are engaged.

As shown in FIG. 8, a plurality of engaging portions 82*c* that protrude to the upward ZA side in the vertical direction Z are provided in the guide member 82. The tip ends on the upward ZA side of the engaging portions 82*c* are bent to the upstream side in the transport direction Y. The plurality of engaging portions 82*c* are respectively disposed to face the surface on the upward ZA side of the protruding portion 91*a* in the regulating member 91. Therefore, movement of the first pressing member 81 in the approach direction WB in the movement direction W is regulated by the engaging portions 82*c* contacting the protruding portion 91*a*. Then, when the head 72 indicated in FIG. 6 further moves in the approach direction WB in the movement direction W after the engaging portion 82*c* and the protruding portion 91*a* come into contact with each other, the position of the head 72 in the movement direction W is changed, but the position of the first pressing member 81 in the movement direction W is not changed. Therefore, the first pressing member 81 is relatively moved in the separation direction WA in the movement direction W with respect to the head 72. That is, for the first pressing member 81, the medium guide surface 81*a* is moved in a direction (hereinafter, referred to as "retreat direction") further away from the belt surface 51*a* than the head surface 72*a* in the movement direction W. Note that, hereinafter, the position of the first pressing member 81 when the engaging portion 82*c* and the protruding portion 91*a* come into contact with each other is set as a retreat position P2 (refer to FIG. 11). The head 72 is able to be moved up to a position at which the tip end of the claw 82*b* contacts an abutting portion (for example, a ceiling surface of the hole 71*d*) that is formed on the upward ZA side of the hole 71*d* or to the approach direction WB side in the movement direction W until the biasing member 92 is maximally compressed.

Next, the actions of the printer 11 of the embodiment will be described.

As shown in FIG. 1, when the printer 11 performs printing on the sheet 14, the transport belt 51 is disposed at the transport position KP. The control device 100 changes the gap G indicated in FIG. 4 by the user operating an operation portion which is not shown in the drawings, or automatically detecting the thickness of the sheet 14 on which printing is performed and moving the head 72 in the movement direction W by controlling the movement mechanism 75 (refer to FIG. 5).

Figure 9:
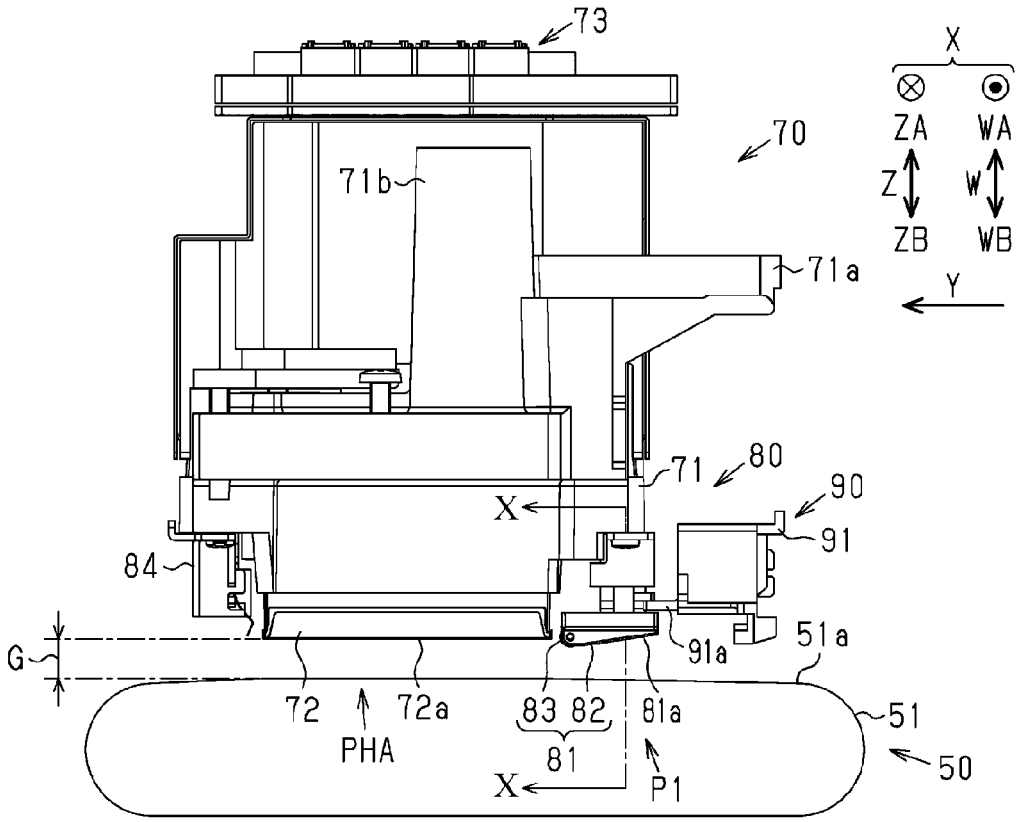
FIG. 9 is a side surface view of the recording portion when the recording portion is at a recording position and a gap is maximal.
Figure 10:
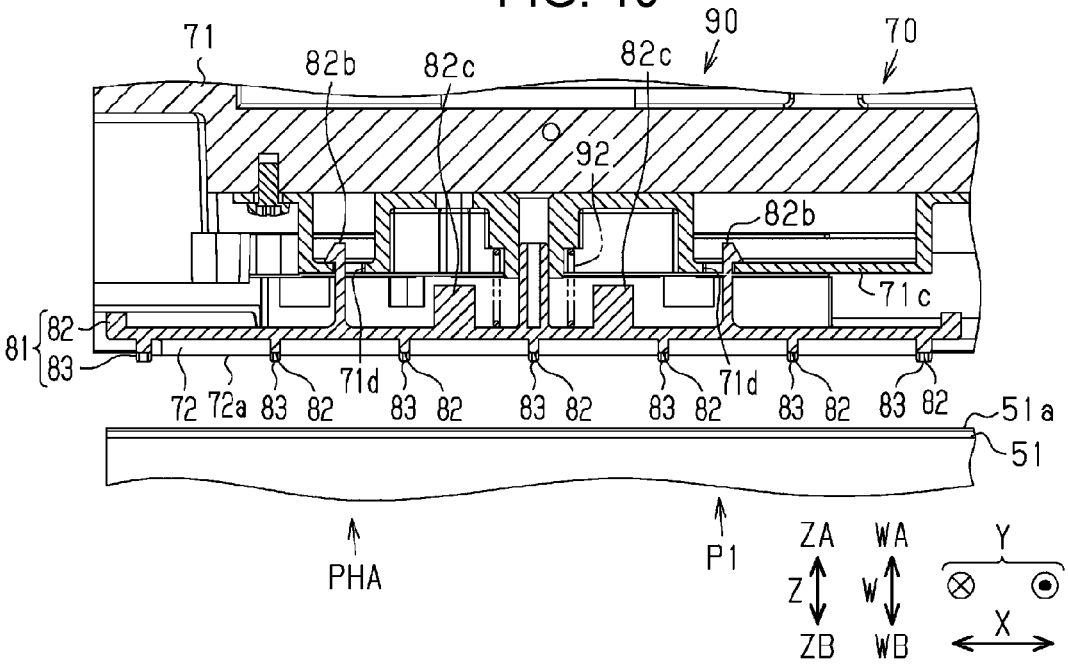
FIG. 10 is a sectional view taken along line X-X in FIG. 9.

In addition, when a paper jam is generated in the transport path 13, the control device 100 indicated in FIG. 1 is able to move the head 72 in the separation direction WA in the movement direction W up to a position at which the gap G indicated in FIGS. 9 and 10 is maximal by controlling the movement mechanism 75 (refer to FIG. 5).

The first pressing member 81 moves in the same manner as the head 72 from the recording position PHA at which the gap G indicated in FIG. 3 is minimal up to the recording position PHA at which the gap G indicated in FIG. 9 is maximal. Therefore, when the head 72 is at the recording position PHA, the end portion of the medium guide surface 81*a* of the first pressing member 81 on the downstream side in the transport direction Y is maintained at a position that is closer to the transport belt 51 than the head surface 72*a*. That is, in the first pressing member 81, when the head 72 is positioned at the recording position PHA, at least a part of the medium guide surface 81*a* is held at the pressing position P1 closer to the belt surface 51*a* than the head surface 72*a* of the head 72. The pressing position P1 also changes according to a change of the recording position PHA. That is, the pressing position P1 corresponds to a plurality of recording positions PHA.

Figure 11:
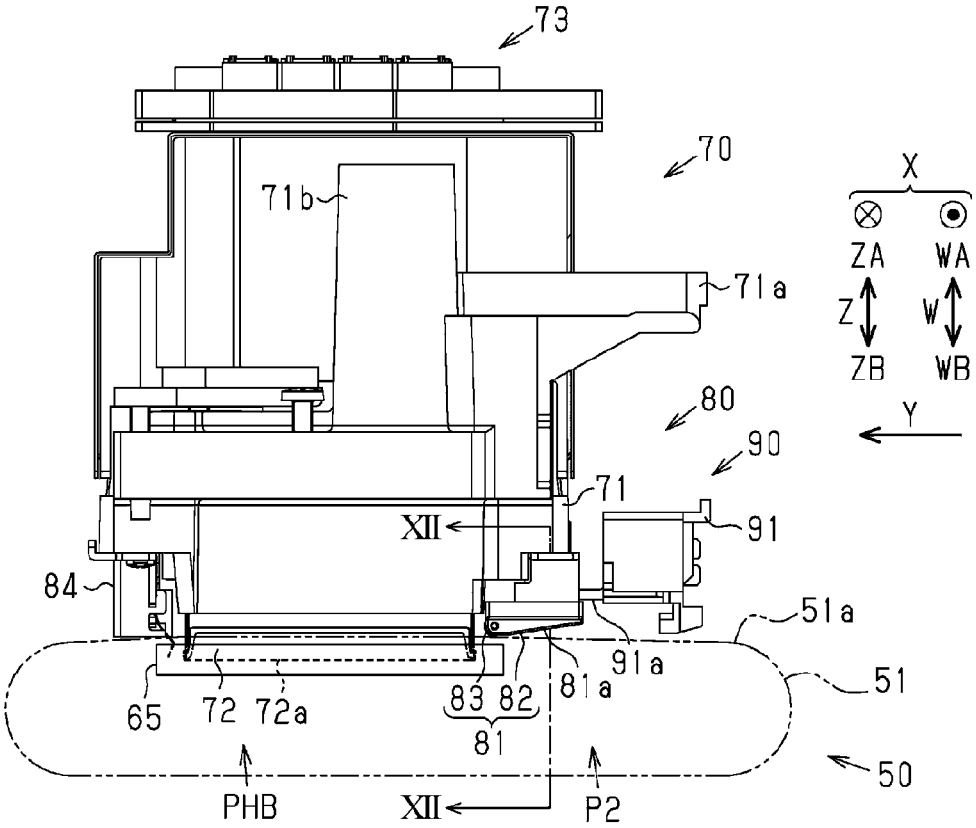
FIG. 11 is a side surface view of the recording portion when the recording portion is at a maintenance position.

As shown in FIG. 2, when the printer 11 performs cleaning of the transport belt 51, the transport belt 51 is disposed at the cleaning position TP. Then, at this time, the control device 100 for suppressing drying of the recording portion 70 causes the cap 65 to approach the head surface 72*a* (refer to FIG. 11) of the head 72 and moves to a cap position on the approach direction WB side further in the movement direction W than the head surface 72*a*. At this time, the control device 100 moves the head 72 as shown in FIG. 11 to a maintenance position PHB further on the approach direction WB side in the movement direction W than the recording position PHA. Not only during cleaning of the transport belt 51, but also during capping in which the printer 11 is covered by the cap 65, as an operation state when maintaining the printer 11 (during maintenance), the head 72 moves to a side (approach direction WB side) that approaches the transport belt 51 in the movement direction W.

Figure 12:
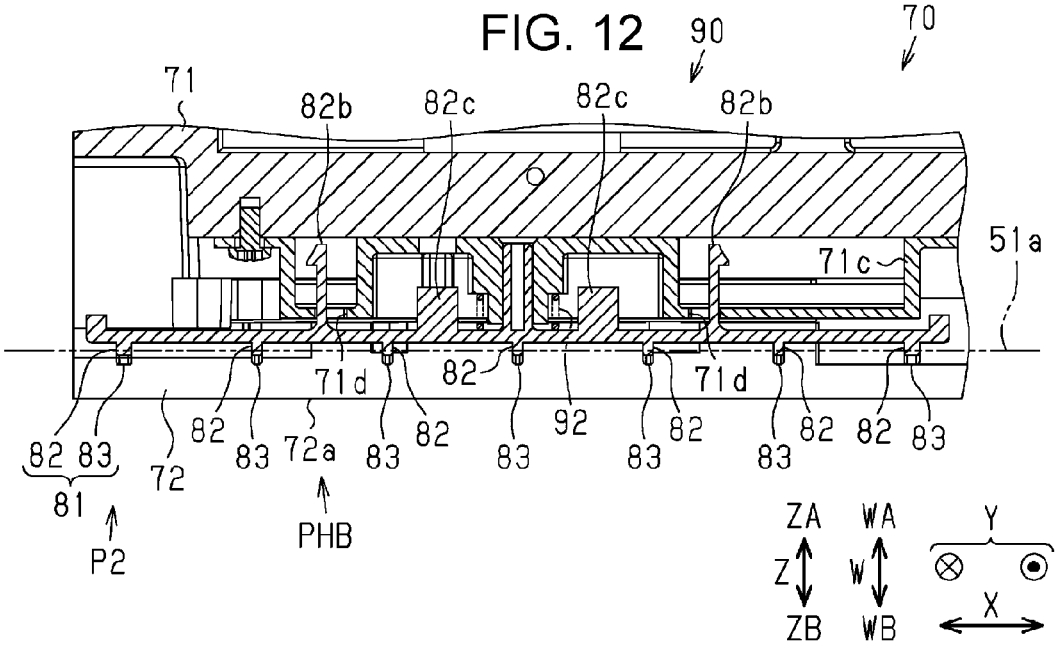
FIG. 12 is a sectional view taken along line XII-XII in FIG. 11.

At this time, in the first pressing member 81, the engaging portion 82*c* (refer to FIG. 12) catches the protruding portion 91*a*, and movement to the approach direction WB side in the movement direction W is regulated. That is, during maintenance, the regulating member 91 engages with the engaging portion 82*c*, and regulates movement of the first pressing member 81 to the approach direction WB side in the movement direction W. Therefore, as shown in FIG. 12, in the guide member 82, the claw 82*b* is positioned further at the separation direction WA side in the movement direction W than the edge of the hole 71*d* of the head frame 71. Then, in the first pressing member 81, the entirety of the medium guide surface 81*a* is positioned further in the separation direction WA in the movement direction W than the head surface 72*a*. That is, the first pressing member 81 moves in the retreat direction that separates further from the belt surface 51*a* than the head surface 72*a* of the head 72 by movement to the side (approach direction WB side) that approaches the transport belt 51 in the movement direction W is regulated by the regulating member 91 during maintenance.

According to the embodiment, it is possible to obtain the effects indicated below.

(1) The printer 11 is able to move the pressing position P1 using the medium guide surface 81*a* of the first pressing member 81 for suppressing lifting up of the sheet 14. That is, when the head 72 is positioned at the recording position PHA and when the head 72 is maintained by cleaning and the like, it is possible to move the first pressing member 81 such that the pressing position P1 and the retreat position P2 are different due to the medium guide surface 81*a*. Therefore, it is possible to appropriately suppress lifting up of the sheet 14 since it is possible to change a gap between the medium guide surface 81*a* and the belt surface 51*a* according to the thickness, the state, or the like of the sheet 14.

(2) For example, in a case where the movement direction from the pressing position P1 of the first pressing member 81 to the retreat position P2 during maintenance and the movement direction W of the head 72 are orthogonal, there is a risk that the printer 11 increases in size due to a plurality of gaps being provided for moving the first pressing member 81 and the head 72 in the printer 11. In this point, in the embodiment, since the retreat direction (movement direction) of the first pressing member 81 is along the movement direction W of the head 72, it is possible to reduce the size of the printer 11 in comparison to a case where the retreat direction is not along the movement direction W.

(3) In the printer 11, the first pressing member 81 moves in the movement direction W in conjunction with movement of the head 72. Therefore, it is possible to set a driving source for moving the head 72 and a driving source for driving the first pressing member 81 commonly to the motor 76.

(4) In the printer 11, the pressing position P1 is changed by also moving the first pressing member 81 that is supported on the head frame 71 when the recording position PHA of the head 72 is changed by moving the head 72 in the movement direction W. Therefore, since it is possible that an amount of movement of the head 72 and an amount of movement of the first pressing member 81 are the same, when the recording position PHA is changed according to the thickness, the state, or the like of the sheet 14, it is also possible to change the pressing position P1 to a position according to the thickness, the state, or the like of the sheet 14.

(5) In the printer 11, since the first pressing member 81 is biased toward the side that approaches the transport belt 51 in the movement direction W, it is possible to further suppress lifting up of the sheet 14 and it is possible to reduce a load that is applied in transport of the sheet 14. In addition, it is possible to increase efficiency of electrostatic adsorption since it is possible to press the sheet 14 on the transport belt 51 with electrostatic adsorption.

(6) In the printer 11, since the outer peripheral surface 83*a* of the roller 83 is included on the medium guide surface 81*a*, movement in the transport direction Y when the sheet 14 contacts the medium guide surface 81*a* is assisted by the roller 83. Therefore, it is possible to reduce the load that is applied in transport of the sheet 14.

(7) Since the transport belt 51 of the printer 11 transports the sheet 14 by electrostatic adsorption, lifting up of the sheet 14 is further suppressed. In addition, in a transport method using the transport belt 51 with electrostatic adsorption, it is preferable for the distance between the medium guide surface 81*a* and the belt surface 51*a* to approach the thickness of the sheet 14 in order to reliably press the sheet 14 on the belt surface 51*a*. The printer 11 is able to change the position of the medium guide surface 81*a* during printing. Therefore, it is possible to suppress reduction of printing quality by changing the distance between the medium guide surface 81*a* and the belt surface 51*a* according to the thickness of the sheet 14.

Note that, the embodiment may be modified to the following other embodiments.

Figure 13:
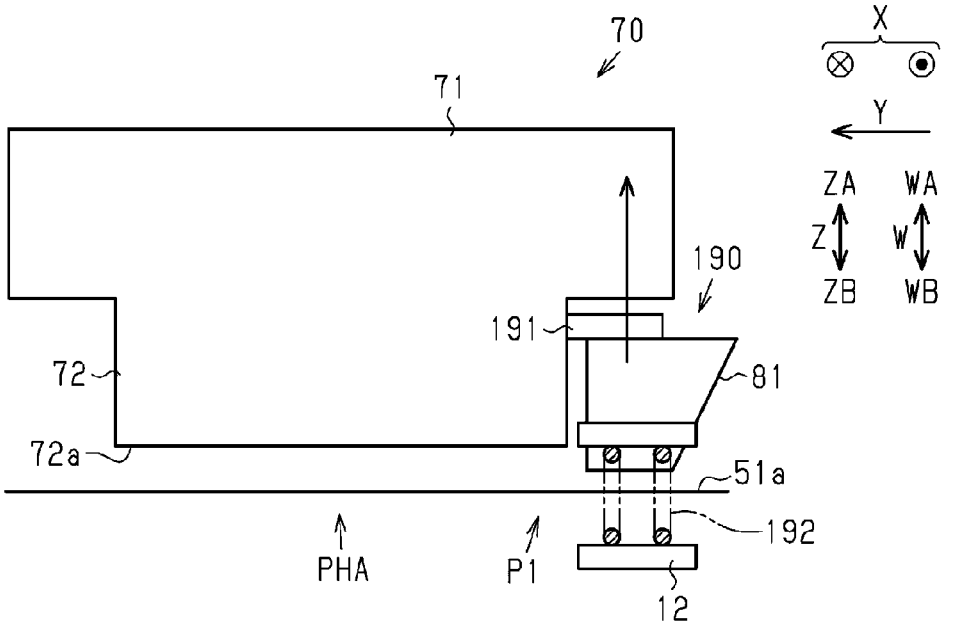
FIG. 13 is a side surface view of a recording portion when the recording portion of a modification example is at a recording position.
Figure 14:
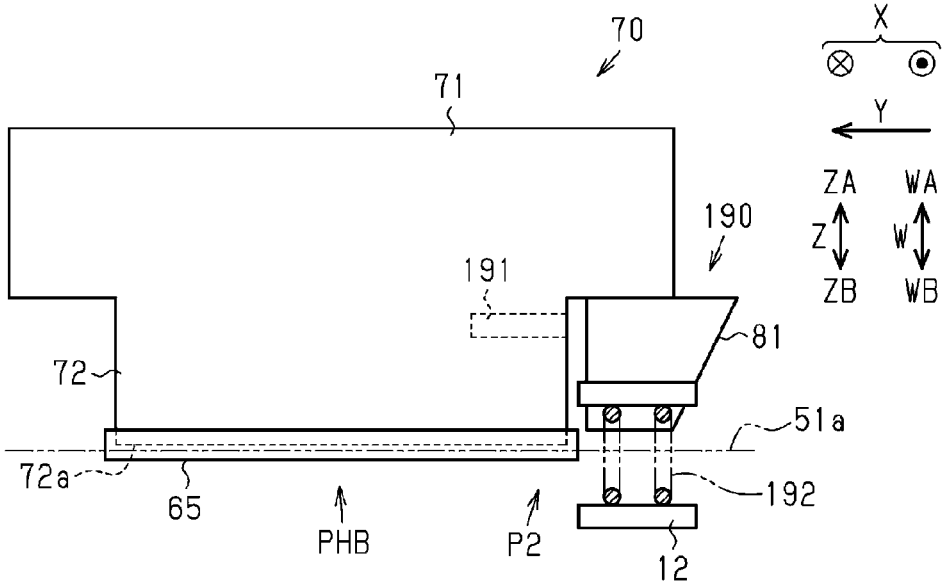
FIG. 14 is a side surface view of the recording portion when the recording portion in FIG. 13 is at the maintenance position.

It is also possible to change the holding mechanism 190 of the embodiment to the holding mechanism 90 that is shown in FIGS. 13 and 14. A holding mechanism 190 is provided with a regulating member 191 that regulates movement of the first pressing member 81 by contacting the first pressing member 81 at the pressing position P1 and a biasing member 192 that applies force to the first pressing member 81 toward the head frame 71. For example, one end of the biasing member 192 is attached to the casing 12 further on the approach direction WB side in the movement direction W than the first pressing member 81. The one end of the biasing member 192 is attached to the first pressing member 81. Therefore, the biasing member 192 applies force, toward the separation direction WA side in the movement direction W, to the first pressing member 81. The regulating member 191 is provided in the head frame 71 to be able to contact the surface on the separation direction WA side in the movement direction W of the first pressing member 81. The holding mechanism 190 is further provided with a driving mechanism that accommodates the regulating member 191 on the head frame 71.

The control device 100 moves the regulating member 191 within the head frame 71 and separates the regulating member 191 from the first pressing member 81 during maintenance. Therefore, the first pressing member 81 moves to the separation direction WA side in the movement direction W due to biasing of the biasing member 192 and moves in the retreat direction (separation direction WA in the movement direction W) further away from the belt surface 51*a* than the head surface 72*a* of the head 72.

Figure 15:
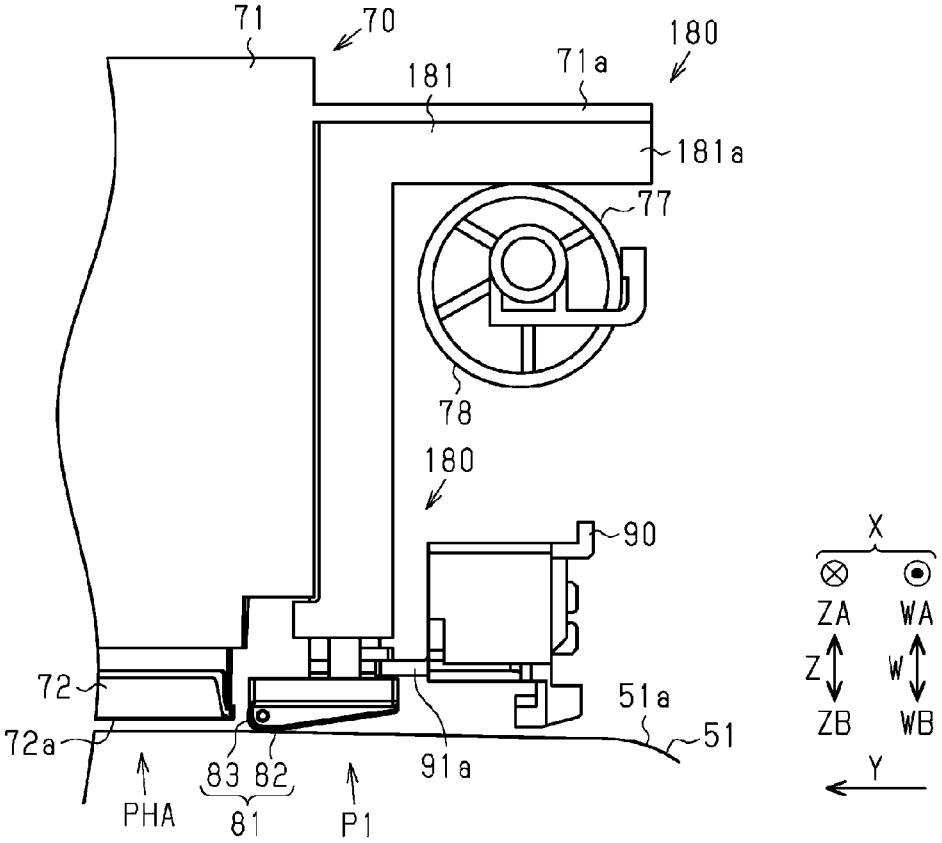
FIG. 15 is a partial side surface view of a recording portion of a modification example.
Figure 16:
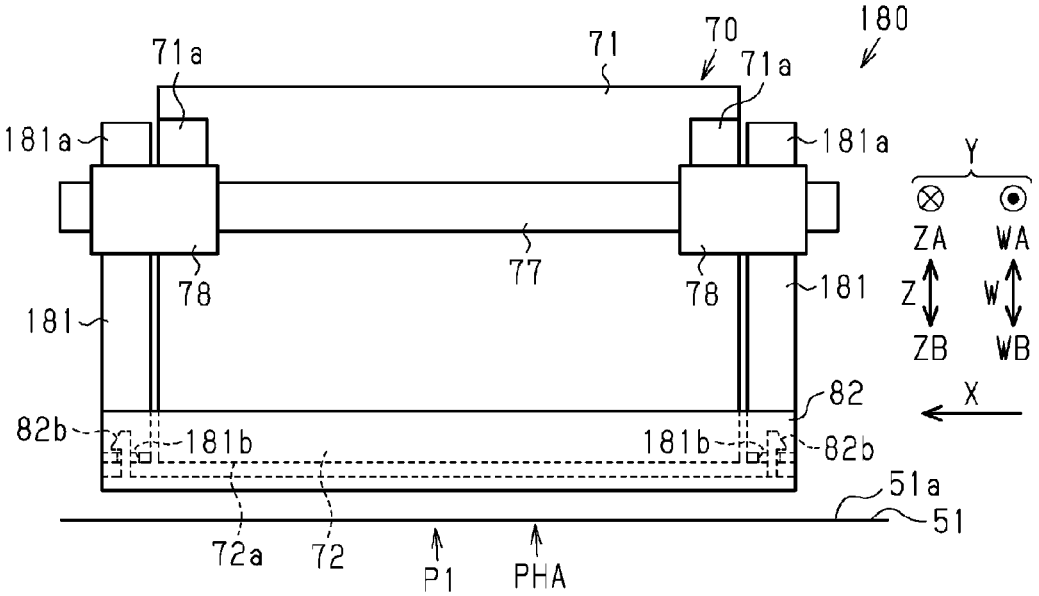
FIG. 16 is a rear surface view of the recording portion in FIG. 15.

It is also possible to change the pressing mechanism 80 in the embodiment to the pressing mechanism 180 that is shown in FIGS. 15 and 16. The pressing mechanism 180 is provided with a support body 181 that has a cam receiving portion 181*a* that is able to contact a part on the upward ZA side of the cam 78. The claw 82*b* of the guide member 82 is able to catch the edge of a hole 181*b* that is formed on an end portion at the downward ZB side of the support body 181. The first pressing member 81 presses up on the cam 78 or moves along the movement direction W accompanying gravity due to rotation of the cam shaft 77. That is, the first pressing member 81 is moved in the movement direction W by the cam 78.

In a modification example illustrated in FIGS. 15 and 16, it is also possible to provide the cam shaft 77, a second cam shaft that is different from the cam 78, and a second cam, and for the cam receiving portion 181*a* to engage with the second cam. In the modification example, it is also possible to connect the second cam shaft to the driving source that is different from the cam shaft 77. It is possible for the control device 100 to retreat the first pressing member 81 from the head surface 72*a* during maintenance by driving the cam shaft 77 and the second cam shaft separately from each other.

It is also possible to retreat (move) the first pressing member 81 in the embodiment in the retreat direction that is not along the movement direction W. Also in this case, inhibition of maintenance of the head surface 72*a* by the first pressing member 81 is suppressed by moving the first pressing member 81 to a position that is more sufficiently separated from the belt surface 51*a* than the head surface 72*a*.

It is also possible to omit the roller 83 from the first pressing member 81 in the embodiment.

In the embodiment, it is also possible to adopt a transport roller instead of the transport belt 51. The transport roller may not perform electrostatic adsorption. In this case, the support portion is configured by a plate shape member, and is moved to a position that is separated from the head 72 during maintenance of the head 72.

In the embodiment, the belt moving portion 60 may not necessarily be configured to move the transport belt 51 between the transport position KP and the cleaning position TP by swinging with the roller shaft of the driving roller 52 as the center. For example, the transport belt 51 may be configured to move between the transport position KP and the cleaning position TP by parallel movement without moving due to swinging.

In the embodiments, the transport belt 51 may be an endless belt which bridges between a plurality of rollers of three or more. Note that, in this case, in at least two rollers out of the plurality of rollers, in the embodiment, one roller is set as the driving roller 52 which is a swing center for the transport belt 51, and the other roller is set as the driven roller 53 where the belt surface 51*a*, on which the sheet 14 is transported by facing the recording portion 70, is formed with the driving roller 52.

In the embodiment, the recording portion 70 is not limited to a configuration of a so-called line head which is provided with a liquid discharge head that is able to simultaneously discharge ink across substantially the whole region of the sheet 14 in the width direction X. For example, the recording portion 70 may have a configuration of a so-called serial head which is provided with a liquid discharge head that discharges ink in a carriage that reciprocally moves in the width direction X which intersects with the transport direction of the sheet 14. Here, the case of the configuration of the serial head is a configuration in which the longitudinal direction of the recording portion 70 is a movement direction of the carriage, and the transported sheet 14 is intermittently transported in the transport direction Y.

In the embodiment, a supply source of the ink which is recording liquid that is discharged from the recording portion 70 may be an ink accommodating body which is, for example, provided inside the casing 12 of the printer 11. Alternatively, the supply source may be an ink accommodating body of a so-called external type which is provided externally to the casing 12. In particular, in the case of the external type ink accommodating body, since it is possible to increase the ink capacity, it is possible to perform discharge of a greater amount of ink than from the recording portion 70.

Note that, in a case where ink is supplied from the ink accommodating body which is provided externally to the casing 12 to the recording portion 70, it is necessary to route an ink supply tube for supplying ink from the outside to the inside of the casing 12. Consequently, in this case, it is preferable to provide a hole, a cutout notch, and the like into which it is possible to insert the ink supply tube in the casing 12. Alternatively, a gap is provided in the casing 12, and the ink supply tube may be routed from the outside to the inside of the casing 12 through the gap. By doing this, it is possible to easily perform ink supply with respect to the recording portion 70 using an ink flow path of the ink supply tube.

In the embodiment, the printer 11 as a recording apparatus may be a fluid body discharge apparatus which performs recording by discharging or spraying a fluid body other than ink (including a liquid, a liquid form body in which a particulate functional material is dispersed or mixed in a liquid, a fluid such as gel, and a solid which is able to be discharged by flowing as a fluid). For example, the apparatus may be a liquid form body discharge apparatus which performs printing by discharging a liquid form body including, in a dispersed or dissolved form, material such as an electrode material or color material (pixel material) which is used in manufacture and the like of a liquid crystal display, an electro-luminescence (EL) display, and a surface light emission display. In addition, the liquid form body discharge apparatus may discharge the fluid form body such as gel (for example, physical gel). Then, it is possible to apply the invention to a fluid discharge apparatus of any one of the types. Note that, in the specification "fluid" is a concept which does not include a fluid which comprises only gas, and for example, liquid (including an inorganic solvent, an organic solvent, a solution, a liquid resin, a liquid metal (molten metal), and the like), a liquid form body, a fluid form body, a powder and granular body (including a granular body and powder body), and the like are included in fluid.

The entire disclosure of Japanese Patent Application No. 2015-240311, filed Dec. 9, 2015 is expressly incorporated by reference herein.

What is claimed is:

1. A recording apparatus comprising:

a head that moves in a movement direction that is orthogonal to a support surface of a support portion that supports a medium which is transported in a transport direction, is positioned at a plurality of recording positions in the movement direction, and discharges liquid from a liquid discharge surface onto the medium; and a medium pressing member that has an inclined medium guide surface and a roller member at a downstream side in the transport direction of the guide surface which faces the medium, wherein when the head is positioned at the recording position, the medium pressing member is held at a pressing position corresponding to the plurality of recording positions with at least a part of the medium guide surface closer to the support surface than the liquid discharge surface of the head, whereas during maintenance of the head, the medium pressing member being moveable to a retreat position at which the medium guide surface is further away from the support surface than the liquid discharge surface of the head.

2. The recording apparatus according to claim 1, wherein a direction in which the medium pressing member moves from the pressing position to the retreat position is along the movement direction of the head.

3. The recording apparatus according to claim 2, wherein the medium pressing member moves in the movement direction in conjunction with the movement of the head.

4. The recording apparatus according to claim 3, further comprising:

a head frame that supports the head and moves the head in the movement direction; and a regulating member that engages with an engaging portion provided in the medium pressing member and regulates movement of the medium pressing member during maintenance of the head, wherein the head moves to a side approaching the support portion in the movement direction during maintenance of the head, and the medium pressing member is supported on the head frame that is held at the pressing position further on the upstream side in the transport direction than the head, and during maintenance of the head, moves in a direction further away from the support surface than the liquid discharge surface of the head due to regulation of movement to the side that approaches the support portion in the movement direction using the regulating member.

5. The recording apparatus according to claim 4, wherein the medium pressing member is biased toward the side that approaches the support portion in the movement direction with respect to the head frame.

6. The recording apparatus according to claim 3, further comprising:

a head frame that supports the head and moves the head in the movement direction;

a biasing member that applies force toward the head frame in the medium pressing member; and a regulating member that regulates movement of the medium pressing member by contacting the medium pressing member at the pressing position, wherein the medium pressing member is supported on the head frame that is held at the pressing position further on the upstream side in the transport direction than the head, and during maintenance of the head, moves in a direction further away from the support surface than the liquid discharge surface of the head by moving the regulating member inside the head frame.

7. The recording apparatus according to claim 3, further comprising:

a head frame that supports the head; and a cam that moves the head in the movement direction by moving the head frame in the movement direction, wherein the medium pressing member is moved in the movement direction by the cam.

8. The recording apparatus according to claim 1, wherein the support portion is a transport belt that transports the medium using electrostatic adsorption.

9. The recording apparatus according to claim 1, wherein the roller has an axis of rotation along a direction orthogonal to the transport direction of the medium.

* * * * *